US006256855B1

(12) United States Patent
Schall

(10) Patent No.: US 6,256,855 B1
(45) **Date of Patent: *Jul. 10, 2001**

(54) HINGE PIN REMOVER

(76) Inventor: Richard L. Schall, 1375 Pacific St., Redlands, CA (US) 92373

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/566,920

(22) Filed: Dec. 4, 1995

(51) Int. Cl.[7] ..... B25B 27/02; B25B 7/02

(52) U.S. Cl. ..... 29/275; 29/426.5; 81/426.5; 81/463

(58) Field of Search ..... 29/275, 278, 426.5, 29/11; 81/424.5, 426.5, 418, 463; 16/254

(56) References Cited

U.S. PATENT DOCUMENTS

| | | | |
|---|---|---|---|
| 273,612 | | 3/1883 | Schellenberger . |
| 827,392 | | 7/1906 | Prangemeier . |
| 1,073,802 | | 9/1913 | Fulghum . |
| 1,661,365 | | 3/1928 | Gendron . |
| 1,813,038 | | 7/1931 | Erne . |
| 1,821,953 | | 9/1931 | White . |
| 2,071,897 | | 2/1937 | Pazzano . |
| 3,689,977 | | 9/1972 | Crabbe . |
| 4,188,701 | | 2/1980 | Ludwig . |
| 4,206,663 | | 6/1980 | Pace . |
| 4,757,730 | | 7/1988 | Porat et al. . |
| 5,012,367 | * | 4/1991 | Toensing ..... 29/426.5 X |
| 5,226,230 | | 7/1993 | Klinger . |
| 5,735,031 | * | 4/1998 | Johnson ..... 29/426.5 |

* cited by examiner

*Primary Examiner*—S. Thomas Hughes
(74) *Attorney, Agent, or Firm*—Knobbe, Martens, Olson & Bear, LLP

(57) ABSTRACT

A hinge pin remover comprised of a pair of plier members, each having a jaw portion and a handle portion, wherein the plier members are pivotally connected. A circular indentation is formed in each of the jaw portions of the plier members that is configured to fit around the shaft of a hinge pin. An edge is formed in the circular indentations which can be interposed between the bottom of the head of the hinge pin and the top surface of a flange forming a channel for the hinge pin. Pivoting the jaw members together results in the edges being interposed between the hinge pin head and the flange. Subsequently, an upward force can be exerted against the hinge pin remover to remove the hinge pin. Further, a bevelled surface is formed adjacent the edges of the indentation so that the bevelled surface can be interposed between the head of the hinge pin and the flange which results in the bevelled surface exerting an outward force against the hinge pin to remove the hinge pin from the channel. Strike plates are also formed on the plier members which further facilitate removal of the hinge pin from the channel as a user can hammer against the strike plates to further exert an outward force against the hinge pin captured within the openings formed in the plier members.

11 Claims, 2 Drawing Sheets

HINGE PIN REMOVER

BACKGROUND OF THE INVENTION

1. Field of the Invention

The present invention generally relates to hand-held tools and, in particular, concerns a tool for removing hinge pins from hinges to facilitate the removal of doors.

2. Description of the Related Art

Removing previously hung doors is often necessary when doing construction or renovations around a house or office building. The people who have to remove doors include painters, finish carpenters, carpet layers, vinyl and tile installers, door hangers, cabinet installers, moving companies, appliance dealers and home owners. For example, doors are often removed to allow for larger pieces of furniture to be positioned inside of a room and also when carpeting in and around the door is being replaced.

A door is usually attached to the door frame via a hinge assembly that is comprised of two mating hinge pieces, one of which is positioned on the door frame and the other positioned on the door. These hinge pieces mate together and form a cylindrical channel that receives a hinge pin. The hinge pin which extends through the cylindrical channel holds the two hinge pieces together while allowing the hinge pieces to rotate about an axis defined by the hinge pin.

Typically, the hinge pin is removed by inserting a nail or screwdriver into the bottom opening of the hinge assembly so that it makes contact with the bottom of the hinge pin, and then driving the hinge pin up and out of the channel formed by the hinge pieces. Often a hammer is used to hammer against the nail or screwdriver to drive the hinge pin out of the channel. Once the hinge pin has been slightly removed from the channel, a person can grasp the hinge pin and pull it out either using their bare hand or pliers.

One difficulty with removing hinge pins in this fashion is that the screwdriver or the nail that is inserted into the channel can damage the hinge pin or the hinge pieces. For example, if the nail or screwdriver is positioned adjacent the surface of the hinge pieces and the hinge pin, hammering on the nail or screw may result in gouges being formed in either the outer surface of the hinge pin, the inner surfaces of the hinge pieces, or both. Damage of this type may make subsequent installation of the hinge pin into the channel more difficult. Further, it will be appreciated that hammering a nail or a screwdriver in this fashion results in the hammer being swung substantially adjacent the door. A mis-hit of the screwdriver or nail can result in the hammer damaging the door or the hinge assembly, so as to mar its appearance.

Alternatively, in some circumstances it may be possible to use pliers to remove the hinge pin without running the risk of having a hammer damage the door or hinge assembly. Unfortunately, most hinge pins are usually flushly positioned within the channel in the hinge pieces, and the top end of the hinge pin often has a diameter that is slightly larger than the diameter of the channel so that the hinge pin has to be forced into the channel and is securely retained therein. Hence, it is often very difficult to use pliers to successfully extract the hinge pin. Further, hinge pins can become even more difficult to extract with pliers when the hinge has been painted and the paint is, essentially, gluing the pin inside of the channel.

To address the problems associated with removing hinge pins from hinges, several hinge pin removing devices have been developed. In particular, U.S. Pat. No. 3,689,977 to Crabbe and U.S. Pat. No. 4,188,701 to Ludwig have been developed in order to facilitate the removal of hinge pins from hinge assemblies to thereby permit removal of the door. The Crabbe reference discloses what is in essence a spike that has a first beveled surface at one end. The first beveled surface is configured to be positioned at the interface between the top surface of the hinge pin and the hinge pieces. By pounding the spike inward, the beveled surface works between the hinge pieces and the hinge pin and forces the hinge pin upward out of the channel formed by the hinge pieces. Once the hinge pin is slightly removed from the channel, the spike can then be oriented so a second surface can be positioned against the underside of the head of the hinge pin, and the hammer can then be used to pound the hinge pin upward and out of the channel. One difficulty associated with the Crabbe reference is, however, that the hinge pin can become damaged as a result of hammering the spike against the hinge pin. Further, any mis-hit of the hinge pin can still result in the hammer damaging the door or the hinge pieces.

The Ludwig reference discloses a hinge pin remover that is similar to the hinge pin remover shown in Crabbe in that it also has a beveled surface, i.e., a wedge portion, which is to be positioned between the boundary of the hinge pieces and the hinge pin head. This surface is pounded inward to force the hinge pin away from the hinge pieces and out of the channel. The Ludwig reference also has a striker plate that is positioned perpendicular to the wedge portion which the user can then hammer against to drive the hinge pin upward once the wedge portion has been driven between the underside of the head of the hinge pin and the hinge pieces. The Ludwig reference suffers from the same difficulty as the Crabbe reference in that the wedge portion is being hammered against the hinge pin and can cause damage to the hinge pin. Further, mis-hitting of the hinge pin remover can result in either the hinge pin remover or the hammer damaging the door or the hinge assembly.

Hence, there is a need for a hinge pin remover which facilitates the removal of hinge pins but minimizes the likelihood of damage to the hinge pin and also to the hinge or the door. To this end, there is a need for a hinge pin remover which does not necessitate hammering a wedge or beveled surface toward the hinge pin so that the likelihood of damage to the hinge pin, the hinge member, or the door as a result of mis hammering or hammering too hard can be minimized.

SUMMARY OF THE INVENTION

The aforementioned needs are satisfied by the present invention which is comprised of a hinge pin remover in the configuration of a pair of pliers. The hinge pin remover pliers of the preferred embodiment preferably has an opening configured to fit around the hinge pin and, as the pliers are closed about the hinge pin, a beveled surface positioned adjacent the opening exerts an outward force against the hinge pin. Further, in the preferred embodiment, the beveled surface is configured so that the larger diameter section of the hinge pin is removed from the channel formed by the hinge members upon the pliers being completely closed about the hinge pin.

The hinge pin remover pliers of the preferred embodiment also have strike plates formed on a surface of the pliers to permit the user to hammer against the strike plates to further dislodge the hinge pin. In particular, the opening that closes around the hinge pin is positioned adjacent a first end of the pliers. The strike plate is removed from the first end of the pliers which results in the strike plate being substantially removed from the hinge assembly and also from the door and door frame. It will be appreciated that removing the strike plate from the vicinity of the hinge assembly and door reduces the risk of damage to the hinge assembly and door as a result of the user mis-hitting the strike plate with a hammer.

Further, it will be appreciated that the hinge pin remover of the preferred embodiment reduces the risk of damage to the hinge pin in that a beveled surface is not being driven inward into the shaft of the hinge pin. Rather, the beveled surface is closed around the hinge pin and the pressure of closing the pliers results in the beveled surface exerting an upward force against the head of the hinge pin. It will be appreciated that the user of the hinge pin removal pliers of the preferred embodiment has greater control over the amount of force that is being exerted against the hinge pin. This results in less damage to the hinge pin than in the prior art devices wherein a beveled service is being hammered inward toward the hinge pin.

Consequently, the hinge pin removal pliers of the present invention are configured to facilitate the removal of hinge pins, to thereby permit removal of doors from door frames with less risk of damage to the hinge pins, the hinge assemblies and the doors. Other objects and features of the present invention will become more fully apparent from the following description with reference to the accompanying drawings.

DETAILED DESCRIPTION OF THE PREFERRED EMBODIMENT

Figure 1:
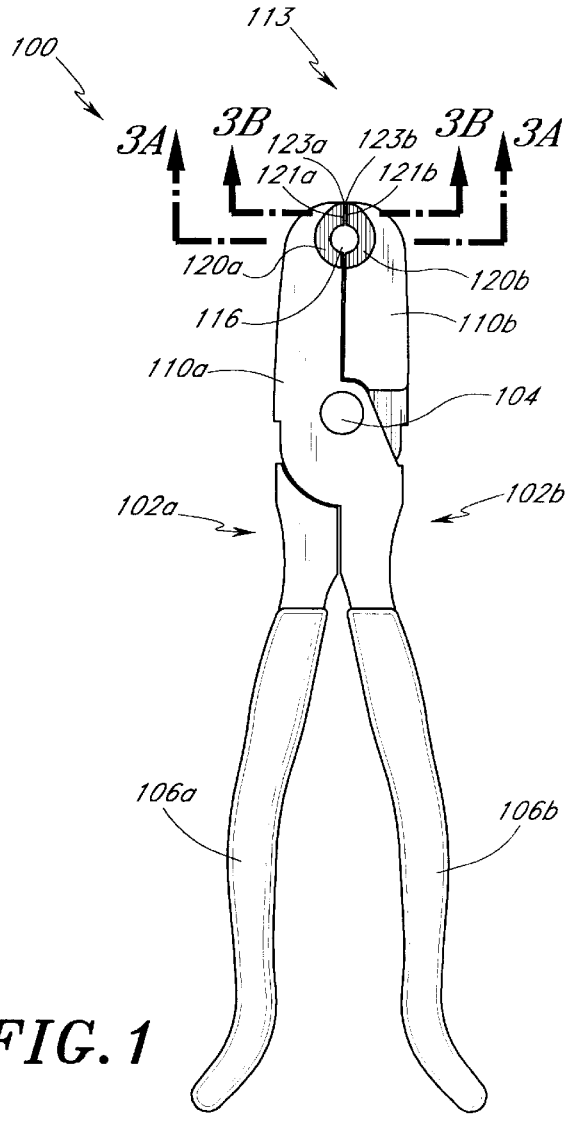
FIG. 1 is a top view of the hinge pin removal pliers of the preferred embodiment.

Reference will now be made to the drawings wherein like numerals refer to like parts throughout. FIG. 1 shows a pair of hinge pin removal pliers 100 of the preferred embodiment. The hinge pin removal pliers 100 of the preferred embodiment are essentially comprised of two plier members 102*a* and 102*b* that are preferably mirrors of each other and are pivotally connected about a pivot pin 104. The plier members 102*a* and 102*b* each have a handle portion 106*a* and 106*b* and a jaw portion 110*a* and lob. Preferably, the plier members 102*a* and 102*b* are configured so that when the handle portions 106*a* and 106*b* are moved toward each other, the jaw members 110*a* and 110*b* also move toward each other. Similarly, movement of the handle members 106*a* and 106*b* away from each other results in the jaw members 110*a* and 110*b* also moving away from one another. Hence, the user of the pliers 100 can close the jaw members 110*a*, 110*b* about a hinge pin, in the manner described hereinbelow, by simply grasping the handle portions 106*a*, 106*b* and squeezing them together. Similarly, the user can release the hinge pin from the jaw members 110*a*, 110*b* by moving the handle portions 106*a*, 106*b* apart.

As shown in FIG. 1, each of the jaw portions 110*a*, 110*b* of the plier members 102*a*, 102*b*. Adjacent a first end 113 of the plier members 102*a*, 102*b*, a generally half-circle indentation 114*a*, 114*b* is formed in the plier members 102*a* and 102*b* respectively. The half-circle indentations 114*a* and 114*b* are formed so that when the pliers 100 are closed in the manner shown in FIG. 1, the half-circle indentations 114*a* and 114*b* define a circular hole 116. Further, the half-circle indentations 114 have a beveled edge 120*a* and 120*b* positioned adjacent to the circular hole 116. In the embodiment shown in FIG. 1, the bevelled surfaces 120*a* and 120*b* are bevelled at approximately a 45 degree angle axially along the length of the jaw members 102*a* and 102*b* respectively. Hence, adjacent the first end 113, the bevelled surfaces 120*a* and 120*b*, respectively, form an edge surface 121*a* and 121*b*. Further, in this embodiment, a cutting surface 123 is formed at the forward edge of the bevelled surfaces 120*a* and 120*b* which can be used for trimming edges and the like. The function and purpose of the edge surfaces and bevelled surfaces will be described in greater detail with reference to FIGS. 3–6 herein below.

Figure 2:
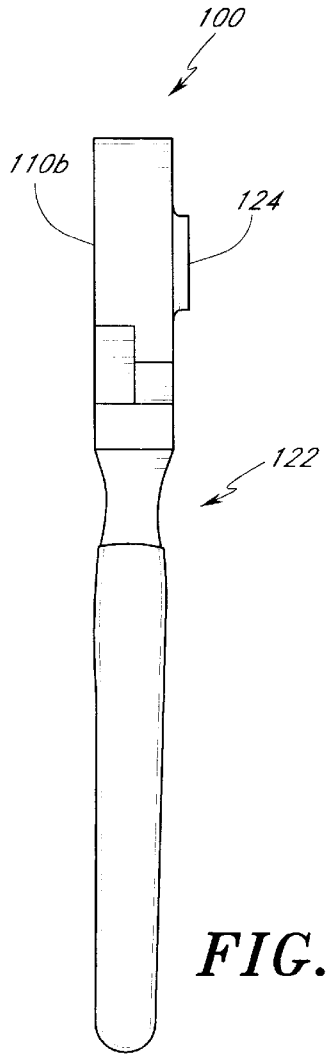
FIG. 2 is a side view of the hinge pin removal pliers of FIG. 1.

FIG. 2 is a side view of the hinge pin removal pliers 100 shown in FIG. 1. In this view, a strike plate 124 is shown on the bottom side 122 of the hinge removal pliers 100. Preferably, there is a strike plate 124 formed on each of the jaw portions 110*a*, 110*b* of the plier members 102*a*, 102*b* respectively. In the preferred embodiment, the strike plate 124 is comprised of a raised surface of metal that is integrally formed on the jaw portions 110*a*, 110*b* of the plier members 102*a*, 102*b*. As will be described in reference to FIG. 4, the strike plate 124 provides a surface against which a user can hammer to facilitate removal of a hinge pin that is captured in the circular hole 116 in the jaw portions 110*a* and 110*b* of the hinge pin removal pliers 100. In the preferred embodiment, the strike plate 124 is raised approximately ⅛" forward of the bottom surface 122 of the hinge pin removal pliers 100. This raised surface is preferably wider and longer than the typical width of the average hammer so as to provide a large striking surface against which to hammer.

Figure 3A:
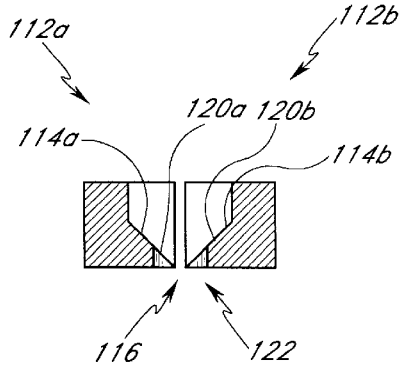
FIG. 3A is a detailed view of a circular opening formed in the hinge pin removal pliers of FIG. 1, configured to fit around a hinge pin.
Figure 3B:
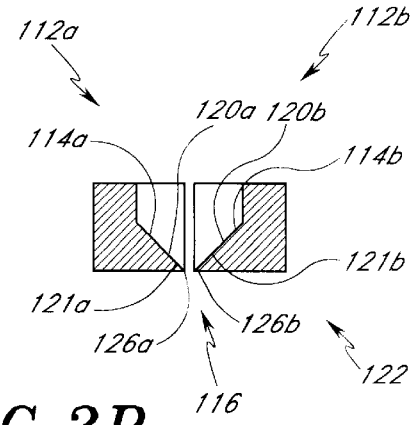
FIG. 3B is a detailed view of a circular opening formed in the hinge pin removal pliers of FIG. 1, illustrating the cross-section of an edged surface.

FIG. 3*a* is a cross-sectional view of the jaw portions 110*a* and 110*b* of the pliers 100. In particular, FIG. 3*a* illustrates that the circular indentations 114*a*, 114*b* that are formed in the jaw members 110*a* and 110*b* respectively. Consequently, the beveled surfaces 120*a* and 120*b* are positioned immediately adjacent the bottom surface 122 of the jaw portions 110*a* and lob of the pliers to form an edge 126*a*, 126*b* positioned immediately adjacent the bottom surface 122 of the pliers 100. The beveled surfaces 120*a*, 120*b* then angle upward away from the bottom surface 122 of the jaw portions 110*a*, 110*b* of the pliers 100. The function of the edge 126*a*, 126*b* and the beveled surfaces 120*a*, 120*b* will be described in greater detail in reference to FIGS. 5 and 6 hereinbelow.

Figure 4:
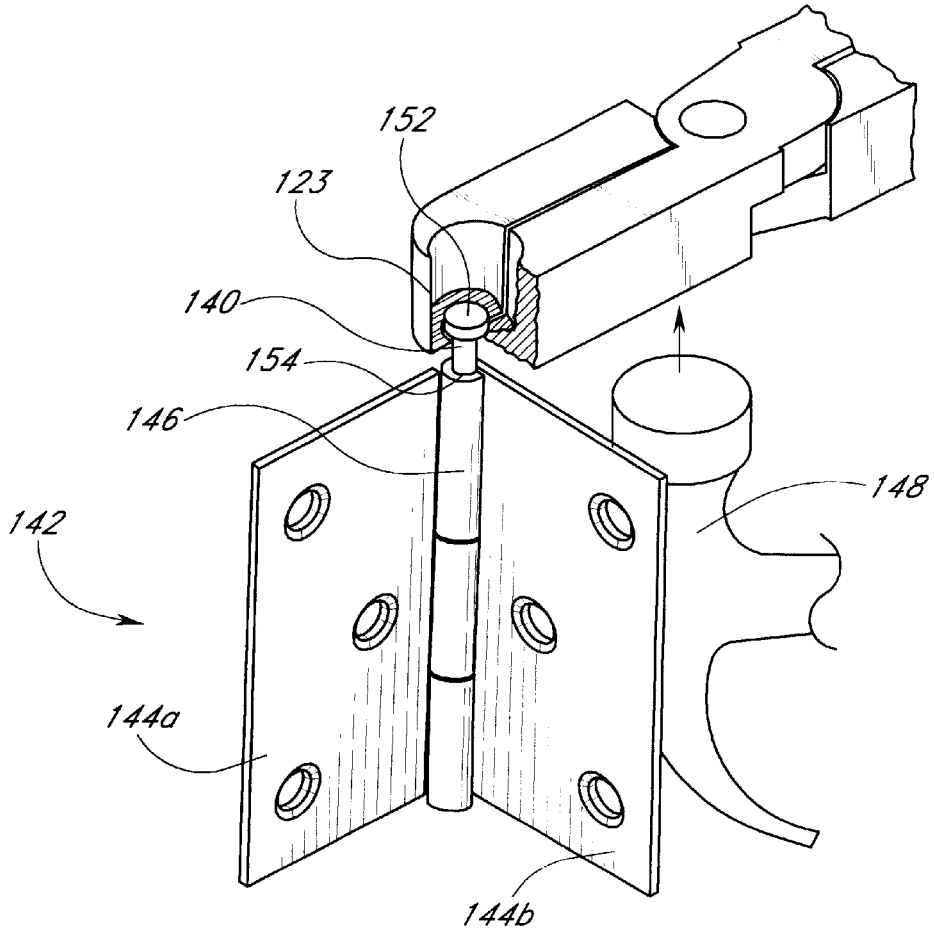
FIG. 4 is a partial perspective view of the hinge pin removal pliers of FIG. 1 being used to remove a hinge pin.
Figure 5:
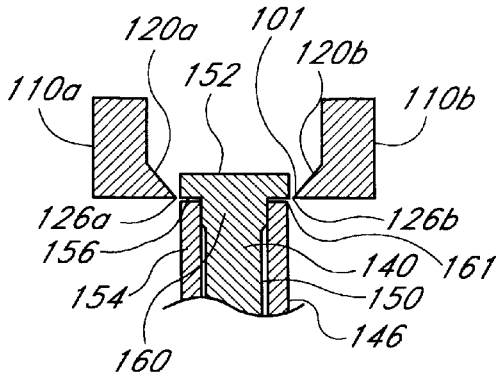
FIG. 5 is a cross-sectional view of the jaw members of the hinge pin removal pliers of FIG. 1, illustrating how a beveled edge of the opening shown in FIG. 3 is positioned between a flange of a hinge pin and the hinge member.
Figure 6:
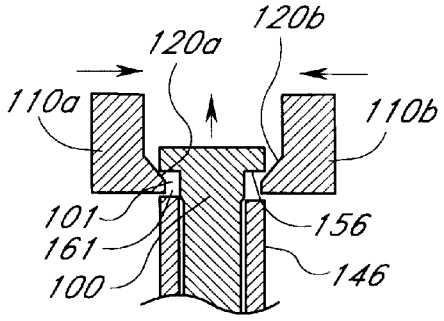
FIG. 6 is a cross-sectional view of the jaw members of the hinge pin removal pliers of FIG. 5, illustrating how the closing of the jaws of the hinge pin removal pliers results in the hinge pin being urged upward out of the hinge assembly.

FIGS. 4–6 illustrate how the pliers 100 of the preferred embodiment are used to remove a hinge pin 140 out of a hinge 142. As is shown in FIG. 4, the typical hinge has two hinge members 144*a* and 144*b* that have circular flanges 146 which mate to form a circular channel 150 (FIGS. 5–6) that is configured to receive the hinge pin 140. Typically, one of the hinge members 144 is attached to the door, and the other is attached to the door frame. Hence, the hinge pin 140, when it is positioned within the channel 150, retains the hinge members 144*a*, 144*b* together, but allows the hinge members 144*a*, 144*b* to rotate with respect to each other about an axis defined by the hinge pin 140. The hinge pin 140 includes a head 152 positioned at the upper end of the hinge pin 140.

As is shown in FIG. 5, when the hinge pin 140 is positioned within the channel 150, a bottom surface 156 of the hinge pin head 152 is preferably positioned substantially flush against an upper surface 154 of the circular flange 146 of the hinge members 144. Preferably, the pliers 100 are positioned so that the edges 121*a* and 121*b* are positioned between the upper surface 154 of the flange 146 and the bottom surface 156 of the head 152 of the hinge pin 140 in the manner shown in FIG. 5. At this point, the jaw portions 110*a*, 110*b* are somewhat separated as the user maneuvers the jaw members 110*a*, 110*b* around the hinge pin 140. Once the edges 121*a*, 121*b* of the jaw portions 110*a*, 110*b* of the pliers 100 are positioned at the boundary between the upper surface 154 of the flange 146 and the bottom surface 156 of the head 152 of the hinge pin 140, the user then moves the handle portions 106*a*, 106*b* of the pliers 100 toward one another which results in the jaw portions 110*a*, 110*b* moving toward one another and closing about the hinge pin 140.

The bevelled edge surface 121*a* and 121*b* adjacent the edge 126*a* and 126*b* exerts an upward force against the bottom surface 156 of the head 152 of the hinge pin 140 to urge the hinge pin 140 out of the channel 150. Subsequently, once the hinge pin 140 is removed a first distance from the channel 150, the user can then reposition the pliers 100 so that the hinge pin 140 is positioned within the circular opening 116. The jaw members 110*a* and 110*b* can be further moved towards each other resulting in the bevelled surface 120*a* and 120*b* urging the hinge pin 140 out of the channel 150.

As shown in FIG. 6, as the edges of the bevelled surfaces are inserted into a crack or opening 161 between the bottom surface 156 of the hinge pin head 152 and the upper surface 154 of the flange 146, the upwardly beveled surfaces 120 of the circular indentation 114*a*, 114*b* urge the hinge pin 140 outward of the channel 150 formed by the flanges 146 of the hinge members 144*a* and 144*b*. As is also shown in FIGS. 5 and 6, the typical hinge pin 140 has a greater diameter section 160 that is positioned immediately adjacent the head 152 of the hinge pin. This greater diameter section 160 is preferably configured so that when the hinge pin 140 is driven into the hinge members 144*a* and 144*b*, the greater diameter section 160 forms a compression fit with the hinge members 144*a* and 144*b* to securely retain the hinge pin within the channel 150 in the hinge members 144*a* and 144*b*. This compression fit, however, makes removal of the hinge pin 140 difficult without the exertion of some force to free the greater diameter section 160 from the channel 150. However, in the preferred embodiment, the beveled edges 120*a*, 120*b* are configured to exert an upward force against the bottom surface 156 of the hinge pin head 152 as the jaw portions 110*a*, 110*b* are closed around the hinge pin 140. Preferably, the beveled surfaces 120 are configured so that the movement of the jaws 110*a*, 110*b* toward each other results in the greater diameter section 160 of the hinge pin 140 being completely removed from the channel 150 in the manner shown in FIG. 6. Specifically, the bevelled surfaces 120*a*, 120*b* are preferably angled so that as the jaw portions 110*a*, 110*b* are closed together into the configuration shown in FIG. 1, the bevelled surfaces 120*a*, 120*b* exert sufficient force to lift the greater diameter section 160 out of the channel 150 of the hinge assembly.

Preferably, once the greater diameter section 160 of the hinge pin 140 is removed from the channel 150, the hinge pin can then be fully removed from the channel 150 by simply pulling it out using the pliers 100. However, it will be appreciated that in some circumstances the hinge pin 140 will still be difficult to remove from the channel 150. However, as is shown in FIG. 4, a hammer 148 can be applied to the strike plates 124 (FIG. 2) to exert an upward force against the head 152 of the hinge pin 140 to fully remove the hinge pin 140 from the channel 150. It will be appreciated that, since the hammer is being struck against the strike plates in a direction that is parallel to the door, the probability of damage to the door as a result of a mis-hit of the strike plates 124 on the pliers is reduced. Further, since the strike plates 124 are positioned on the pliers a distance from the first end 113 of the pliers 100, the likelihood of damage to the door as a result of a mis-hit is further reduced.

The pliers of the preferred embodiment provide a means for removing hinge pins from hinges that does not require an edge to be driven into a crack between the hinge and the head of the hinge pin. Rather, the leverage of the pliers 100 being used to position the edge 126 of the beveled surface 120*a*, 120*b* into the crack 161 between the head 152 of the hinge pin 140 and the flange 146 of the hinge members 144*a* and 144*b*. Since the user can better control the amount of force exerted to insert the edge into the crack between the hinge pin and the hinge members, the likelihood of damage to the hinge and hinge pin is reduced. Further, since a beveled surface is being inserted into the crack and the force of leverage applied by the pliers 100 is translated into a vertical force against the head 152 of the hinge pin 140, the larger diameter section 160 of the hinge pin 140 can be readily removed from the channel 150 of the hinges 144*a*, 144*b*. Hence, the pliers of the preferred embodiment facilitate the removal of hinge pins from hinges while reducing the likelihood of damage to the hinge pin, the hinge assembly, or the door.

Although the foregoing description of the preferred embodiment of the preferred invention has shown, described, and pointed out the fundamental novel features of the invention, it will be understood that various omissions, substitutions, and changes in the form of the detail of the apparatus as illustrated as well as the uses thereof, may be made by those skilled in the art without departing from the spirit of the present invention. Consequently, the scope of the present invention should not be limited by the foregoing discussion, but should be defined by the appended claims.

What is claimed is:

1. An apparatus for removing hinge pins from hinge assemblies, in combination with a hinge assembly having a hinge pin the combination comprising:

a hinge pin having a shaft and a head positioned on one end of the shaft wherein the outer dimension of the head is greater than the outer dimension of the shaft and the shaft is adapted to be positioned in a hinge with the head positioned adjacent a flange of the hinge assembly;

a first plier member having a jaw portion with a first and a second surface extending the length of the jaw portion and a handle portion;

a second plier member having a jaw portion with a first and a second surface extending the length of the jaw portion and a handle portion, wherein said second plier member is pivotally attached to the first plier member so that said jaw portions of said first and said second plier members can be closed together in response to a user moving said handle portions of said first and said second plier members;

a first opening extending between the first and second surface of the jaw portion of the first plier member having a first edge and a first bevelled surface formed in the jaw portion of said first plier member so that the first edge is immediately adjacent the first surface of the jaw portion of the first plier member and the bevelled surface is positioned immediately adjacent the first edge and bevels upwards toward the second surface of the first plier member; and a second opening extending between the first and second surface of the jaw portion of the second plier member having a second edge formed in the jaw portion of said second plier member so that the second edge is immediately adjacent the first surface of the jaw portion of the second plier member and the bevelled surface is positioned immediately adjacent the second edge and bevels upwards to the second surface of the second plier member, wherein said first and said second openings are so dimensioned and relatively positioned so that, when said jaw portions of said pliers are closed together, both the first and the second edges and the first surface of the jaw portion of the first and second plier members are co-planar such that said first and second openings close around said hinge pin with said first and said second edge positioned between said head of said hinge pin and said flange of said hinge assembly so that the first and second bevelled surface urge the hinge pin in a first direction away from the first surface of the first and second plier members and towards the second surface of the first and second plier members to thereby impart an outward force on said hinge pin to urge the hinge pin in a first direction to remove said hinge pin from a channel formed in said hinge assembly.

2. The hinge pin remover of claim 1, wherein a bevelled surface is formed on said first and said second plier members adjacent said first and said second edges so that, when said plier members are closed about said hinge pin, said bevelled surface is interposed between said head of said hinge pin and said hinge assembly and urges said hinge pin out of said channel.

3. The hinge pin remover of claim 2, wherein said bevelled surface is configured so that, when said plier members are closed about said hinge pin, said bevelled surface exerts a sufficient force against said head of said hinge pin to remove a greater diameter section of said hinge pin from said channel.

4. The hinge pin remover of claim 1, wherein first and said second circular indentations are formed adjacent a first end of said first and said second plier members and said first and said second plier members are pivotally connected at substantially a mid-point of said first and said second plier members.

5. The hinge pin remover of claim 4 further comprising a strike plate formed on the first surface of said first plier member of said hinge pin remover so as to extend in a direction substantially normal to the first direction at a position substantially adjacent said mid-point of said first and said second plier members wherein said strike plate is configured so that a hammer can be hammered against said strike plate when said hinge pin is captured within said circular opening to facilitate removal of said hinge pin from said channel.

6. The hinge pin remover of claim 5, wherein said first and said second plier members have a top and a bottom surface and wherein said first and said second edges are formed in said first and said second plier members substantially adjacent said bottom surface of said first and said second plier members.

7. The hinge pin remover of claim 6, wherein said strike plate is comprised of a first strike plate formed on said bottom surface of said first plier member and a second strike plate formed on said bottom surface of said second plier member and wherein said first and said second strike plates are positioned substantially adjacent each other when said first and said second plier members are closed around said hinge pin.

8. An apparatus for removing hinge pins from hinge assemblies, in combination with a hinge assembly having a hinge pin the combination comprising:

a hinge pin having a shaft and a head positioned on one end of the shaft wherein the outer dimension of the head is greater than the outer dimension of the shaft and the shaft is adapted to be positioned in a hinge with the head positioned adjacent a flange of the hinge;

a first plier member having a jaw portion with a first and a second surface extending the length of the jaw portion and a handle portion;

a second plier member having a jaw portion with a first and a second surface extending the length of the jaw portion and a handle portion, wherein said second plier member is pivotally attached to said first plier member so that said jaw portions of said first and said second plier members can be closed together in response to a user moving said handle portions of said first and said second plier members;

a first opening having a first edge and a first bevelled surface formed in the jaw portion of said first plier member so that the first edge is immediately adjacent the first surface of the jaw portion of the first plier member and the bevelled surface is positioned immediately adjacent the first edge and bevels upwards towards the second surface of the first plier member wherein the first opening extends from the first surface to the second surface of the first plier member; and a second opening having a second edge formed in the jaw portion of said second plier member so that the second edge is immediately adjacent the first surface of the jaw portion of the second plier member and the bevelled surface is positioned immediately adjacent the second edge and bevels upwards to the second surface of the second plier member, wherein the second opening extends from the first surface to the second surface of the second plier member and wherein said first and said second openings are so dimensioned and relatively positioned so that, when said jaw portions of said pliers are closed together, both the first and the second edges and the first surface and the second surface of the first and second plier members are substantially co-planar such that said first and second openings close around said hinge pin with said first and said second edge positioned between said head of said hinge pin and said flange of said hinge assembly so that the first and second bevelled surfaces urge the hinge pin in a first direction away from the first surface of the first and second plier members and towards the second surface of the first and second plier members to thereby impart an outward force on said hinge pin to urge the hinge pin in a first direction to remove said hinge pin from a channel formed in said hinge assembly.

9. The apparatus of claim 8, wherein said first and said second plier members have a top and a bottom surface and wherein said first and said second edges are formed immediately adjacent said bottom surfaces of said first and said second plier members.

10. The apparatus of claim 9, wherein said jaw portions of said plier members have an outer end and said first and second indentations are positioned adjacent said outer end of said jaw portions of said plier members and wherein said first and second plier members are pivotally attached at substantially a mid-point along each of said plier members.

11. The apparatus of claim 10, further comprising one or more strike plates formed on said bottom surface of said plier member in a direction normal to the first direction so that, when a user is striking said strike plates with a hammer, said hammer is being swung in a direction substantially parallel to a door on which said hinge assembly is mounted and wherein said one or more strike plates are positioned adjacent said mid-point of said plier members so that said hammer is striking said apparatus at a distance away from said hinge assembly that is positioned adjacent said outer end of said jaw portions of said plier members.

* * * * *